US010173811B2

(12) United States Patent
Stevens et al.

(10) Patent No.: US 10,173,811 B2
(45) Date of Patent: Jan. 8, 2019

(54) DUAL HINGE FLIP CAP CLOSURE

(71) Applicant: Weatherchem Corporation, Twinsburg, OH (US)

(72) Inventors: Kevin Stevens, Twinsburg, OH (US); Brian David Groubert, Boardman, OH (US)

(73) Assignee: WEATHERCHEM CORPORATION, Twinsburg, OH (US)

( * ) Notice: Subject to any disclaimer, the term of this patent is extended or adjusted under 35 U.S.C. 154(b) by 0 days.

(21) Appl. No.: 14/743,235

(22) Filed: Jun. 18, 2015

(65) Prior Publication Data

US 2015/0368002 A1 Dec. 24, 2015

Related U.S. Application Data

(60) Provisional application No. 62/014,049, filed on Jun. 18, 2014.

(51) Int. Cl.

*B65D 43/16* (2006.01)
*B65D 43/22* (2006.01)
*B65D 47/08* (2006.01)

(52) U.S. Cl.

CPC ..... *B65D 43/16* (2013.01); *B65D 43/22* (2013.01); *B65D 47/0804* (2013.01); *B65D 47/0852* (2013.01); *B65D 2543/00435* (2013.01)

(58) Field of Classification Search

CPC ..... B65D 43/16; B65D 47/0852; B65D 47/0804; B65D 43/22; B65D 2543/00435

USPC ..... 220/254.1–254.9; 222/478, 481, 482; 215/228

See application file for complete search history.

(56) References Cited

U.S. PATENT DOCUMENTS

| | | | | | |
|---|---|---|---|---|---|
| 4,369,901 | A * | 1/1983 | Hidding | B65D 47/0852 | 222/142.7 |
| 4,903,870 | A * | 2/1990 | La Vange | B65D 47/305 | 220/254.6 |
| 5,415,312 | A * | 5/1995 | Mueller | B65D 47/089 | 220/254.3 |
| 6,269,986 | B1 * | 8/2001 | Gross | B65D 47/0804 | 222/153.06 |
| 6,382,476 | B1 * | 5/2002 | Randall | B65D 47/0885 | 215/237 |
| 7,021,481 | B2 * | 4/2006 | St. Germain | A47G 19/2272 | 215/230 |
| 8,844,745 | B2 * | 9/2014 | Peters | B65D 43/164 | 220/264 |
| 2004/0118846 | A1 * | 6/2004 | Merolla | B65D 47/08 | 220/254.2 |
| 2006/0108364 | A1 * | 5/2006 | Benktzon | B65D 50/062 | 220/324 |

(Continued)

*Primary Examiner* — Kareen Thomas

(74) *Attorney, Agent, or Firm* — Amin, Turocy & Watson, LLP

(57) ABSTRACT

The disclosed aspects relate to a dual hinge flip cap closure. The closure includes a skirt that operatively engages a container. The closure also includes a top connected to the skirt at a first hinge, wherein the top is movable relative to the skirt. Further, the closure includes a lid operatively attached to the top at a second hinge, wherein the lid is movable relative to the top, and wherein a distal end of the lid is at an opposite of the top relative to the first hinge and the second hinge is between the first hinge and the end of the lid.

14 Claims, 6 Drawing Sheets

(56) References Cited

U.S. PATENT DOCUMENTS

| | | | | |
|---|---|---|---|---|
| 2007/0056972 | A1* | 3/2007 | Solowiejko | B65D 21/022 220/254.2 |
| 2008/0230543 | A1* | 9/2008 | Kick | B65D 47/0838 220/254.3 |
| 2011/0309078 | A1* | 12/2011 | Rathbone | A23G 3/563 220/254.3 |
| 2013/0068765 | A1* | 3/2013 | Procter | B65D 43/0212 220/254.3 |

* cited by examiner

DUAL HINGE FLIP CAP CLOSURE

CROSS-REFERENCE TO RELATED APPLICATIONS

This application claims the benefit of priority from Provisional Application Ser. No. 62/014,049 filed on Jun. 18, 2014, which is hereby incorporated by reference in its entirety.

TECHNICAL FIELD

The following description relates generally to a closure and more particularly to a dual hinge flip cap closure.

BACKGROUND

Dispensing closures and associated containers can be utilized with a vast variety of products, which can be in any number of forms (e.g., liquid, powder, solid, as a pill, and so on). In some cases, a user may want or desire to have multiple options for dispensing the product from the container. Some dispensing closures can have two or more flaps with different sizes or styles of openings to allow the product to be dispensed at different rates. With traditional dispensing closures however, by incorporating multiple flaps a fully open dispensing option is precluded.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

An aspect relates to a dual hinge flip cap closure. The closure can include a skirt configured to engage a container. The closure can also include a top connected to the skirt at a first hinge, wherein the top is movable relative to the skirt. Further, the closure can include a lid operatively attached to the top at a second hinge, wherein the lid is movable relative to the top, and wherein a distal end of the lid is at an opposite of the top relative to the first hinge and the second hinge is between the first hinge and the end of the lid.

In another aspect, the embodiments described herein can include a container assembly that includes a container and a closure. The closure can include a skirt that operatively engages the container and a first flap connected to the skirt at a first hinge, wherein the first flap is movable relative to the skirt. The closure can also include a second flap operatively attached to the first flap at a second hinge, wherein the second flap is movable relative to the first flap, and wherein a distal end of the second flap is at an opposite of the first flap relative to the first hinge and the second hinge is between the first hinge and the end of the second flap.

In another aspect, the embodiments described herein can include a closure that has a skirt, and a top connected to the skirt at a first live hinge, wherein the top is movable relative to the skirt. The closure can also include a flap with a second live hinge connecting a first end of the flap to the top, wherein the flap is movable relative to the top, and wherein a second end of the flap, opposite the first end of the flap, is at a radial edge of the top opposite the first hinge, and wherein the second hinge is between the first hinge and the second end of the flap.

In an implementation, the top is movable in a first direction and the lid is movable in a second direction. According to another implementation, the top provides full-open dispensing capabilities. In accordance with another implementation, the lid provides less than full-open dispensing capabilities.

To the accomplishment of the foregoing and related ends, one or more aspects comprise features hereinafter fully described and particularly pointed out in the claims. The following description and annexed drawings set forth in detail certain illustrative features of one or more aspects. These features are indicative, however, of but a few of various ways in which principles of various aspects may be employed. Other advantages and novel features will become apparent from the following detailed description when considered in conjunction with the drawings and the disclosed aspects are intended to include all such aspects and their equivalents.

BRIEF DESCRIPTION OF THE DRAWINGS

Various non-limiting embodiments are further described with reference to the accompanying drawings in which.

DETAILED DESCRIPTION

Figure 1:
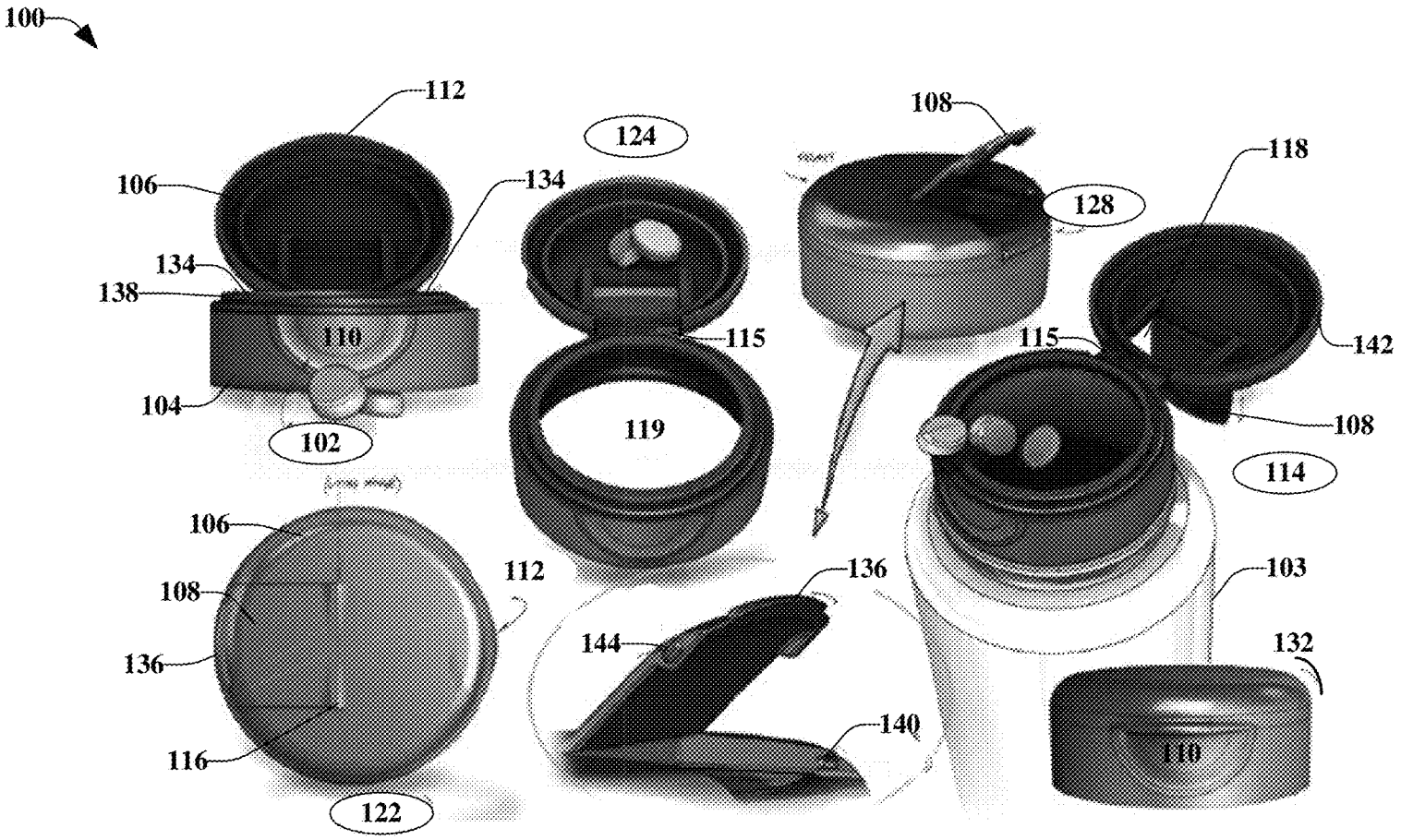
FIG. 1 illustrates example, non-limiting views of an embodiment of a closure according to an aspect.

Various aspects are now described with reference to the drawings, wherein like reference numerals are used to refer to like elements throughout. In the following description, for purposes of explanation, numerous specific details are set forth in order to provide a thorough understanding of one or more aspects. It may be evident, however, that the disclosed subject matter can be practiced without these specific details, or with other methods, components, materials, and so forth. In other instances, well-known structures and components may be shown in block diagram form in order to facilitate describing one or more of the aspects disclosed herein.

A closure can be provided that has two sizes of opening to dispense product, where one of the openings provides a full-size opening, (i.e., an opening size that is limited by the size of the container that the closure is attached to. A closure can have a lid or a top that is connected to the skirt via a first hinge, and the lid can include a flap that is attached to the lid via a second hinge. The flap opening can be on an opposite side of the lid from the first hinge with the second hinge in between the flap opening and the first hinge. In this way, the lid can open relative to the skirt and container at a first angle, and the flap can open at a second angle, 180 degrees opposite the first angle.

The lid and the flap can both have associated indented portions and/or tabs that have different sizes or shapes, which can allow a user to easily determine whether the lid or the flap is being opened, without visual cues. In addition, since the lid and flap open at opposite angles relative to the skirt and container, the indented portions and/or tabs can be on opposite ends of the closure to make it easier to select or distinguish the lid or flap. Each of the lid and flap can include locking features which operatively engage the closure or the lid respectively to keep the container closed.

Turning now to the figures, FIG. 1 illustrates example, non-limiting views of an embodiment of a closure 100 according to an aspect. As illustrated at 102, the closure 100 can include a skirt 104 configured to operatively engage a container (not shown). The closure can also include a top 106 (e.g., a lid portion) that includes a lid 108 (e.g., a flap or flapper), best seen at 128. The lid 108 is shown in its approximate molded position, at 114 (e.g., the lid 108 is molded in an open position relative to the other portions of the top 106). Further, the top 106 can be molded in the open position as well. In some aspects, the lid 108 can be molded separate from the top 106 and the skirt 104 (e.g., in a two-shot injection molding process). According to other implementations, the closure 100 can be molded as a single or unitary unit.

Included in at least a portion of the skirt 104 can be an indented area 110, which can be located near a first end 112 of the top 106. The location of the indented area 110 can allow a user to insert a finger, thumb, or other object, under the first end 112 of the top 106 to facilitate opening the container by moving the top 106 from a first position, illustrated at 122, to an open position as illustrated at 124. According to some aspects, the indented area is a large, visible thumb-tab. In some embodiments, the first end 112 can be an extended portion that has a different curvature than the rest of the top 106 so that a portion of the first end 112 extends over the skirt 104 and the indented portion 110.

The lid 108 can be configured to move from the first position (e.g., a closed position) where a lid portion (e.g., the lid 108) is closed over the top 106 (illustrated at 122) to a second portion (e.g., an open position), illustrated at 128. To move from the first position to the second position, the lid 108 can be moved away from the top 106 at a hinge 116, which can be located near or close to the center of the top 106. The end of the flap or lid 108 can include a tab or lip 136 that hangs over the edge of the top 106 and or skirt 104. The tab 136 can be at an opposite end of the top 106 relative to the extended portion/tab 112 with the hinge 116 in between the tabs 136 and 112.

According to some aspects, another hinge 115 can operatively connect the top 106 to the skirt 104 as shown in 124. For example, the hinge 115 can be a living hinge. In some aspects, the hinge 116 can also be a living hinge. As illustrated, at 114, the hinge 115 can be located adjacent the lid 108. The hinge 115 can be configured to open the top 106 in a first direction relative to a container 103 (e.g., clockwise as illustrated at 128). The hinge 116 can be configured to open the lid 108 in a second direction relative to the container 103 (e.g., counterclockwise as illustrated at 128).

As illustrated at 114, when the lid 108 is moved to its second position (e.g., open position), an opening 118 is exposed, which allows access to contents within the container. The size of the opening 118 can be less than a full-open dispensing capacity. Thus, the lid 108 can be selectively opened when only a small amount of container content is to be dispensed (or is to be dispensed slowly).

Further, as illustrated at 124, when the top 106 is moved to its second position (e.g., open position) another opening 119 is exposed, which also allows access to contents within the container. It is noted that the opening is a full opening size (e.g., about the same size as the mouth of the container) to allow full open dispensing capabilities.

At the first end of the lid 108, a tab 112 can be provided. The tab 112 can correspond to the indented area 110 to facilitate moving the top 106 away from the skirt 104. The tab 112 can comprise a subtle front thumb tab. Further, the closure 100 can have a soft edge and/or rounded edge 132.

According to some aspects, locking beads 134 can be located on both sides of the closure 100 adjacent the opening 119 and formed in a rim 138 at the top of skirt 104. The locking beads 134 can be configured to retain the top 106 in secure engagement over the skirt 104 or over the mouth of the container 103. In addition, locking beads (not shown) can also be formed on a rim 142 to operatively engage the rim 138 on the skirt 104.

As illustrated in the bottom middle embodiment of FIG. 1, the lid 108 can include a lip 136 that extends outward, away from the lid 108. The lip 136 can be a small extended area and can be utilized to facilitate movement (or opening) of the lid 108 relative to the top 106. A corresponding indented portion can be included on the side or edge of top 106. A user can distinguish the indented portion on the top from the indented portion 110 on the skirt based on the size and/or shape of the indented portion so that the user can easily identify and/or select to open either the top 106 or the lid 108.

Additionally, the lid 108 can comprise locking portions 144, wherein one locking portion 144 can be located on a first side of the lid 108 and a second locking portion 144 can be located on a second side of the lid 108 (e.g., a small flapper). The locking portions 144 can be located on an external area of the lid 108 and can be configured to selectively engage complementary portions 140 of the top 106 (which can be located on both sides of the opening in the top 106).

Figure 2:
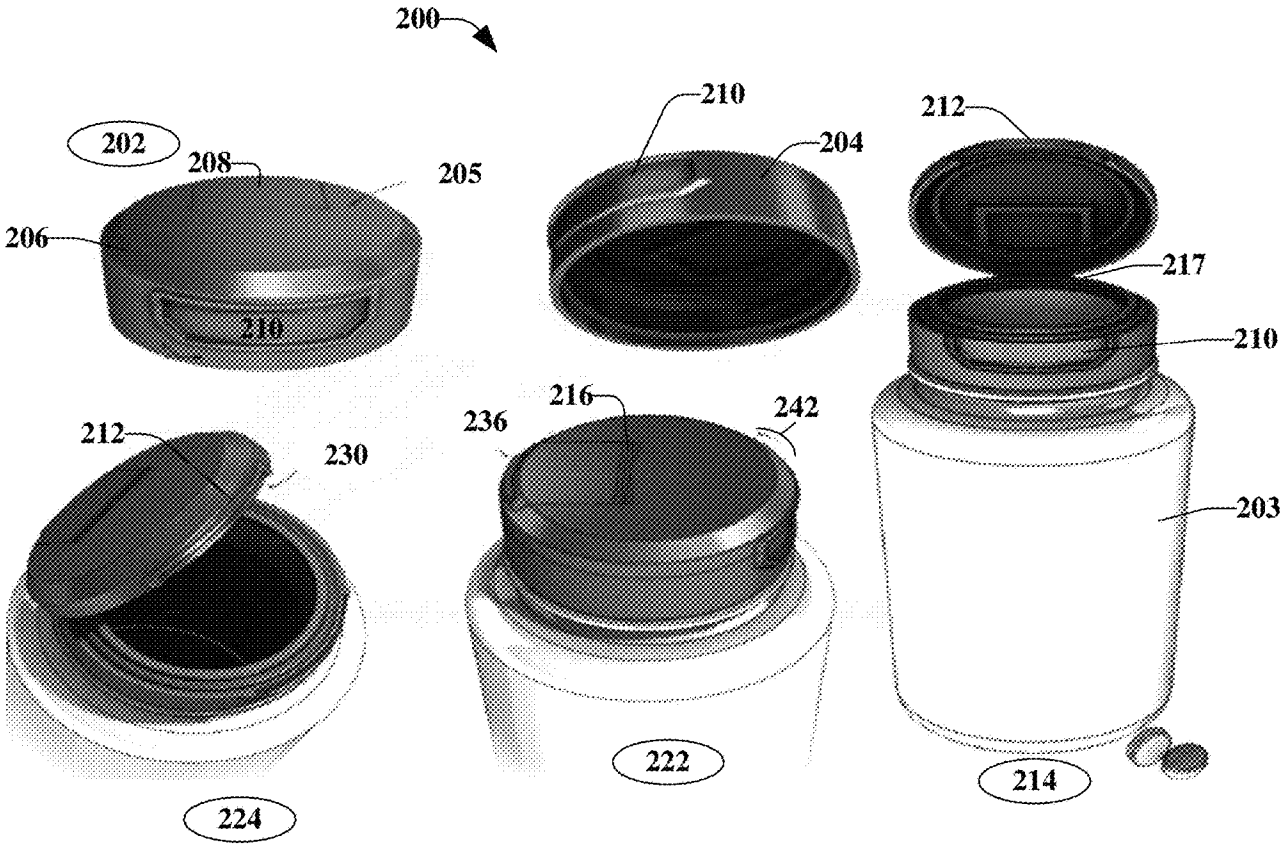
FIG. 2 illustrates example, non-limiting views of an embodiment of another closure according to an aspect.

FIG. 2 illustrates example, non-limiting views of an embodiment of another closure 200 according to an aspect of this disclosure. At 202, a perspective view of the closure is illustrated. In an example, the closure 200 can be utilized with vitamins or prescription drugs or similar products. As shown, the closure 200 can include a top 206 and a lid 208. Also illustrated in FIG. 2 is a first hinge 216 (for the lid 208) and a second hinge 217 (for the top 206). The top 206 can comprise a flat top surface 205. Further, the lid 208 can comprise a flat top surface.

A front perspective view of the closure 200 is illustrated at 214. The closure 200 can include a skirt 204 configured to engage a container 203. The closure 200 can also include an indented area 210 around at least a portion of the skirt 204 (or a side wall).

The indented area 210 can be located such that the indented area 210 corresponds to a first end 212 of the lid 208 As shown at 202 and 214, the indented area 210 can comprise angles around an outer perimeter of the indented area 210 (as compared to the rounded edges of the indented area 110 of FIG. 1). Further, a tab 230 of the top 206 (located at a first end 212) can have a wider width as compared to the tab 112 of FIG. 1. For example, the tab 230 can be about the same width as the indented area 210. According to some aspects, the tab 230 can be wider (or shorter) than the indented area 210.

In this implementation, the lid 208 can comprise a lip 236. According to an aspect, the lip 236 can be a square thumb-tab. However, the disclosed aspects are not limited to this implementation. Further, illustrated at 242 is a corner chamfer around a perimeter of the top 206.

As illustrated by the perspective top view at 222 and at 224, the top 206 (and the lid 208) can be moved from a first position (shown at 202 and 222) to a second position (shown at 214 and 224), which is away from the skirt 204 and the container 203. Although not illustrated in FIG. 2, the lid 208 can also be selectively moved away from the top 206.

Figure 3:
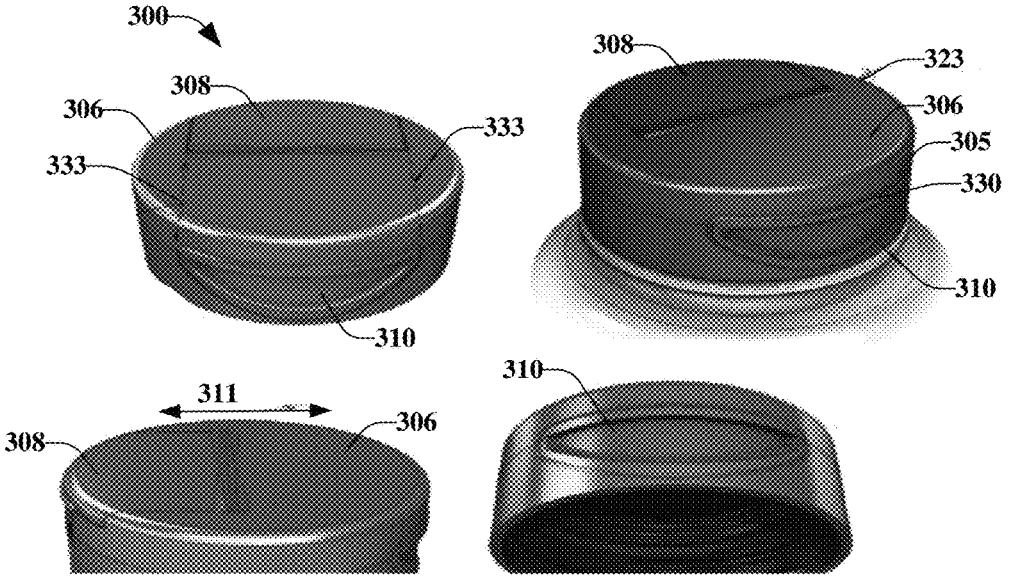
FIG. 3 illustrates example, non-limiting views of an embodiment of a further closure according to an aspect.

FIG. 3 illustrates example, non-limiting views of an embodiment of a additional closure 300 according to an aspect. The closure 300 can include a skirt 304, a top 306, and a lid 308. The top 306 and the lid 308 can be independently opened (e.g., one or the other, or both, can be opened). A sidewall 305 can operatively connect the top 306 and the skirt 304, according to some aspects.

In the illustrated implementation, an indented area 310 can be formed on the skirt 304 or on the sidewall 305 at a first end 312 of the top 306. A tab 330 can be located on the first end of the top 306, corresponding to the indented area 310. The tab 330 (e.g., thumb-tab) can comprise a width that is substantially the same as the width of the lid 306 (e.g., flapper) located on the back side of the closure 300 (as illustrated by the dotted lines 333).

A top surface of the closure (e.g., the top 306 and the lid 308) can have a flat appearance, as illustrated at 311. As depicted at 323, the closure can have a sharper top edge. Further, the indented area 310 can have a wider thumb-tab geometry as compared to the closures 100 and 200 depicted in FIGS. 1 and 2 respectively.

Figure 4:
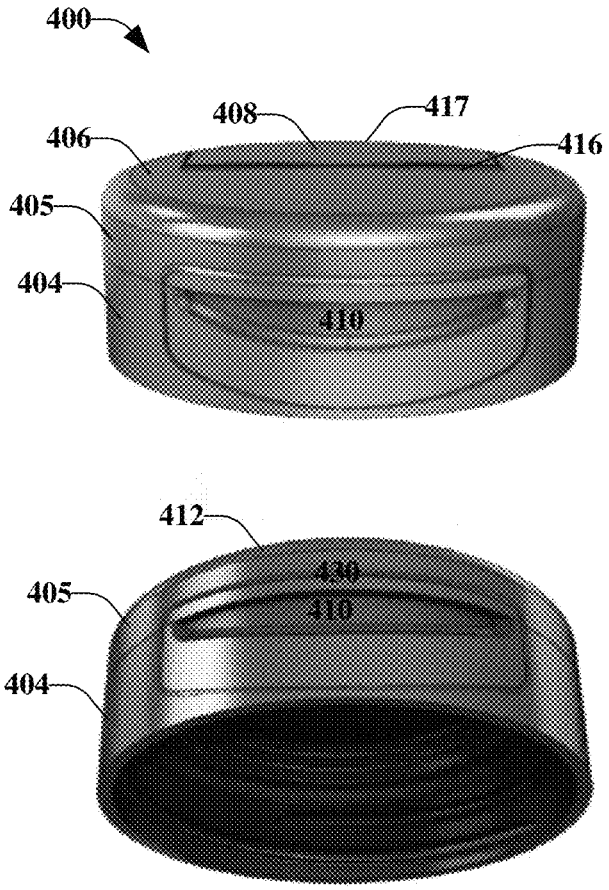
FIG. 4 illustrates example, non-limiting views of an embodiment of still another closure according to an aspect.

FIG. 4 illustrates example, non-limiting views of an implementation of still another closure 400 according to an aspect. The closure can include a skirt 404 and a sidewall 405. An indented area 410 can be formed on at least a front portion of the sidewall 405 (or the skirt 404). Further, the closure 400 can include a top 406 (a first flap) and a lid 408 (a second flap) can be located on the top 406. Both the top 406 and the lid 408 can be selectively opened as discussed herein.

The lid 408 can include a first end 412 that corresponds to a location of the indented area 410. Further, the lid 408 can include a second end 417 opposite the first end 412. A hinge 416 can be located between the second end 417 and the first end 412. Further, the lid 408 can be located adjacent the second end 417. The sidewall 405 can operatively connect the top 406 and the skirt 404.

As illustrated, the indented area can comprise an enhanced geometry (e.g., a "FAT-TAB") and a tab 430 associated with the top 460 can be substantially the same width as the indented area 410. In addition, the indented area or thumb-tab area can be deep (e.g., measured from a top of the closure 400 to a bottom of the closure), as compared to the closures of FIGS. 1, 2, and 3.

Figure 5:
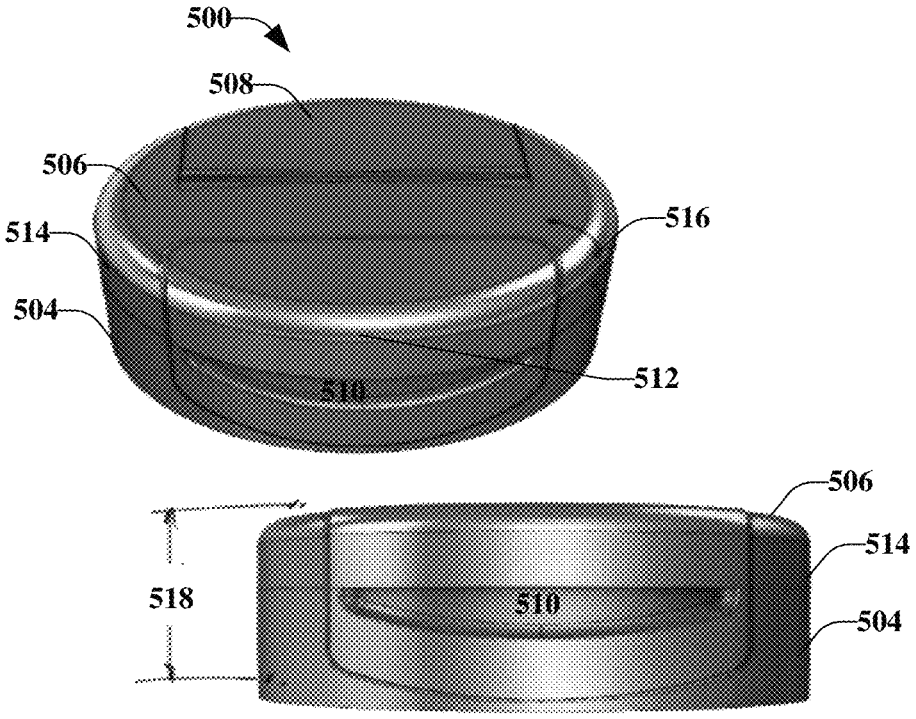
FIG. 5 illustrates example, non-limiting views of an embodiment of yet another closure, according to an aspect.

FIG. 5 illustrates example, non-limiting views of an implementation of yet another closure 500, according to an aspect. Similar to the above figures, the closure 500 can include a skirt 504 configured to engage a container (not shown). Also included can be a top 506 and a lid 508. The lid 508 and the top 506 can be configured to be (independently) selectively movable between a first position (e.g., closed position) and a second position (e.g., an open position). Included on at least a portion of the skirt 504 or on an end wall 514 can be an indented portion 510. The location of the indented portion 510 can correspond with a first end 512 of the top 506.

As illustrated, the indented portion 510 and a tab 530, which together (and/or with other components) can form a thumb-tab 516, identified by the outlined area. The thumb-tab 516, in this implementation, can be configured to wrap to (or over) the top surface. Thus, the thumb-tab 516 extends from the skirt 504 to a portion of the top 506. Further, as illustrated at 518, a height of the thumb-tab is about the same height as the closure 500 (as measured from a top surface of the closure to a bottom surface of the closure 500).

Figure 6:
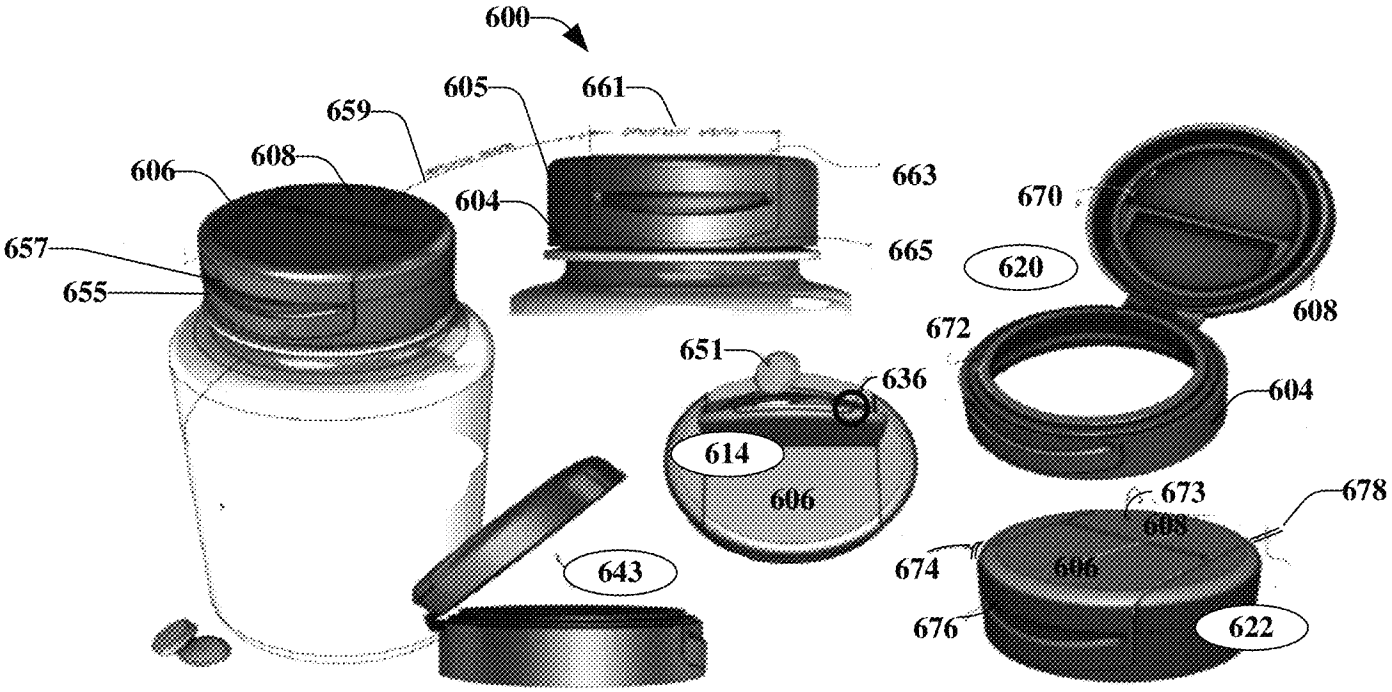
FIG. 6 illustrates example, non-limiting views of an embodiment of another closure, according to an aspect.

FIG. 6 illustrates example, non-limiting views of an implementation of another closure 600, according to an aspect. The closure 600 can include a skirt 604, a top 606, and a lid 608 (e.g., a secondary flapper). A sidewall 605 operatively connects the top 606 and the skirt 604 when the top 606 is closed. The top 606, when opened, can provide full-open dispensing capabilities, as illustrated at 643. Further, the lid 608, when opened, can provide less than full-open dispensing capabilities.

An indented portion 655 can be formed in at least a portion of the skirt 604, the sidewall 605, and the top 606. Thus, the indented portion 655 can wrap around an upper portion of the closure 600. Further, the wrap-around geometry can comprise a contrasting surface finish, as compared to other portions of the closure 600. For example, the finish can be selected from satin, gloss, texture, and so forth. Having a different texture can allow the thumb-tab 655 to stand out or to be easily viewable. Further, an overhang or lip 657 associated with the indented area 655 can form or create a shadow.

As illustrated by arrow 659, the lid 608 and the indented portion 655 can comprise a matching shape. Further, as illustrated by arrow 661, the lid 608 and the indented portion 655 can comprise a constant (or similar) width. Further, the indented portion 655 can comprise a complete (or nearly complete) wrap around geometry, as shown at 663. In addition, the indented portion 655 can have a full length, or can extend approximately to a bottom edge of the closure, as indicated at 665.

As illustrated by the top view 614, the lid 608 can comprise a lip 636. A pill 651 is illustrated being dispensed from the lid 608. Thus, the lid 608 can allow a small amount of product to be dispensed (e.g., less than full-open dispensing capacity) while the top 606 can allow a large amount of product to be dispensed (e.g., full-open dispensing capacity) as shown at 620.

According to some implementations, a seal surface 670 can be located on an underside of the top 606. Further, a perimeter of the opening as shown in 620 can comprise primary locking beads 672. The seal surface 670 and primary locking beads 672 can be configured to securely engage each other.

As illustrated at 622, a top of the closure 600 can comprise a flat top surface 673. This surface can be used for placement of a logo, for example. As illustrated at 674, the closure 600 can comprise a soft edge. Further, a front portion of the top 606 can comprise a front flush surface 676. An edge height difference 678 can be utilized to catch the light for dimension (e.g., visual effect). The edge height difference 678 can be about 0.5 mm, for example.

Although the illustrated closures have a particular size and shape, the disclosed aspects are not limited to these embodiments. Instead, the closure(s) can be any size or shape and the closures illustrated are for example purposes only. Further, the container(s), on which the closure(s) can be operatively attached, can also be any shape or size, which can be selected as a function of contents or product that is to be stored in the container. Examples, of container contents can include powder, granular items, solid or semi-solid contents including food items (e.g., ketchup, mustard, baby food, spices, cookies, cereal, peanuts, grains, and so forth) and non-food items, such as hardware (e.g., nuts, bolts, nails, fasteners, screws) as well as other items (e.g., rock salt, grass seed, sand, and so on). In another example, the container contents can be liquid or semi-liquid contents (e.g., water, orange juice, automotive oil, rubbing alcohol, and so forth). Other examples of container contents can include medicine (e.g., pharmaceutical products) and cosmetics. The container contents that can be utilized with the disclosed aspects are many and, therefore, will not be further discussed herein.

The closure(s) and container(s) can be the same color or can be different colors. For example, the container(s) can be clear and the closure(s) can be colored (opaque). In another example, both the container(s) and the closure(s) can be clear. In accordance with some aspects, the closure(s) and the container(s) can be made of the same material or of a similar material. According to other aspects, the closure(s) and the container(s) are formed of different materials. In an implementation, the container(s) and/or the closure(s) can be formed of a polymer material. According to some implementations, the closure(s) and/or the container(s) can be formed of an injection molded suitable thermoplastic material (e.g., polymer, polypropylene) or other material known in the art.

The closure(s) may be illustrated as a unitary (e.g., a one-piece) structure having a first portion (e.g., a body portion) configured to engage the neck of the container(s) and a second portion (e.g., a lid portion) configured to be movable with respect to the first portion. In accordance with some aspects, the dispensing closure(s) can be formed as a multiple piece structure, wherein the body portion and the lid portion are operatively connected at a hinge. As previously mentioned, although the various aspects are illustrated as a generally circular dispensing closure(s) and/or container(s), the various aspects are not limited to this implementation. In accordance with some aspects, the dispensing closure(s) and/or container(s) can have a different geometric shape (e.g., oval, oblong, and so on).

As mentioned, the lid portion can be movable. For example, the lid portion can be configured to move between a first position (e.g., closed position) and a second position (e.g., open position). For example, the lid portion can be configured to selectively engage the body portion or top (e.g., first position or closed position) and can be further configured to move away from the body portion (e.g., second position or open position). When the lid portion is in the open position, contents (not shown) of the container can be accessed or dispensed.

In an implementation, the lid portion can be configured to, at least temporarily, seal the container such that contents of the container cannot be accessed. Thus, the closure can be moved into its first position for spill-proof purposes and/or for safety purposes (e.g., seals the product within the container, provides an indication that contents of the container might have been tampered with, and so forth). Further, the movable lid portion can be configured to provide easy access to the container and container contents (e.g., through a flip open feature), wherein container contents can be accessed without completely removing the closure from the container.

The container, on which the closure is operatively attached, can include an opening or container mouth. The closure (e.g., body portion, skirt, sidewall, and so on) can be configured to engage a neck (e.g., an upper rim) of the container, wherein the container neck comprises an outer boundary or outer perimeter of the mouth. When in engagement with the container, an opening of the top corresponds to the container mouth such that container contents can be dispensed through the container mouth and the opening.

According to an aspect, the body portion comprises an end wall. According to some aspects, the end wall can be generally circular; however, other configurations are possible with the disclosed aspects. A hollow or tubular skirt depends from the end wall. The skirt can be generally cylindrical or a different shape, which can be a function of the shape of the end wall.

The skirt can be configured to engage with the container. For example, the skirt can engage with a mouth of the container in a threaded manner or in a non-threaded manner. For example, the skirt can include internal screw threads that can operatively engage with complementary screw threads on a neck of the container. According to some aspects, internal threads are not utilized and the dispensing closure is engaged with the container through other means (e.g., snap-on, press-on, and so forth). For example, the closure can operatively engage the container by snapping onto the neck portion of the container (e.g., screw threads are not utilized). However, other means of engaging the closure and the container can be utilized with the disclosed aspects. In an aspect, the container and closure can be a two-piece structure. According to some aspects, the container and the closure are formed as a single piece or single unit. Further, the dispensing closure can engage the container in a removable manner or in a non-removable manner.

An exterior portion of the skirt can be smooth. In another implementation, an exterior portion of a skirt can comprise small vertical grooves or other textural features that can improve a person's ability to grip the dispensing closure for removal from the container (e.g., by unscrewing, by pulling the dispensing closure away from the container, and so on).

A dispensing closure can be installed upright on the top of a container that has a mouth that typically lies in a horizontal plane. For purposes of discussion, the vertical direction generally corresponds to an axial direction with reference to the geometry of the dispensing closure and the horizontal direction or horizontal plane is perpendicular to the axial direction of the dispending closure (e.g., the vertical direction). It should be understood that during molding, the dispensing closure could have a non-upright orientation.

The lid portion (or lid) can be pivotally joined to the end wall (or the top) by, for example, the hinge. The hinge can be a "living hinge", a "pivoting hinge", or another type of hinge. A living hinge is a hinge formed with the body portion and the lid portion as a single piece. A pivoting hinge is formed with the body portion (or the lid portion), wherein the body portion and lid portion are formed as separate pieces and snapped together at the hinge to combine the two pieces. The hinge lies in a plane perpendicular to the axis of the skirt. The hinge allows for ease of moving the lid portion, between the first position and the second position. When in the first position, the lid portion is closed over the body portion and product cannot be dispensed from the container (e.g., for storage purposes). When in the second position, the lid portion is "open" (or moved away from the body portion), which allows product to be dispensed in a full-open manner (e.g., an end user can insert their hand into the container to dispense product.

According to some aspects, the hinge can be constructed of a relatively thin wall that is configured to flex without breakage during an expected service life of the dispensing closure. The hinge allows the lid portion to be moved away from the body portion (e.g., flipped up, placed into the second position) for dispensing in a "full open" manner. The hinge also allows the lid portion to be moved into contact with the body portion (e.g., placed into the first position) for dispensing in a non-full open manner (e.g., in a pourable manner) or for storage purposes.

As discussed above, the size of the container and the container mouth (e.g., portion of the container to which the dispensing closure engages) can be a function of the size of the contents to be stored in the container. If the contents are large or should be dispensed in large quantities, the container, the container mouth, and the dispensing closure can be large. On the other hand, if the contents are small and/or should be dispensed in small quantities, the container mouth and dispensing closure can be small.

Further, the dispensing closure can include components, such as a flap or lid (e.g., lid portion) that can be flipped away from a main portion (e.g., body portion) of the dispensing closure in order to access contents of the container. The flipping or pivot action can provide access to the container contents without the need to completely remove the dispensing closure from the container (e.g., allowing access to the container contents with minimal effort).

The subject matter as described above includes various exemplary aspects. However, it should be appreciated that it is not possible to describe every conceivable component or methodology for purposes of describing these aspects. One of ordinary skill in the art may recognize that further combinations or permutations may be possible. Various methods or constructs may be employed to implement the subject invention, modifications, variations, or equivalents thereof. Accordingly, all such implementations of the aspects described herein are intended to embrace the scope and spirit of subject claims.

In view of exemplary articles of manufacture shown and described herein, methodologies for manufacturing, assembling, and using the one or more disclosed aspects may be implemented in accordance with the disclosed subject matter.

While the foregoing disclosure discusses illustrative aspects and/or embodiments, it should be noted that various changes and modifications could be made herein without departing from the scope of described aspects and/or embodiments as defined by the appended claims. Accordingly, described aspects are intended to embrace all such alterations, modifications, and variations that fall within scope of appended claims. Furthermore, although elements of described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

To the extent that the term "includes" is used in either the detailed description or the claims, such term is intended to be inclusive in a manner similar to the term "comprising" as "comprising" is interpreted when employed as a transitional word in a claim. Furthermore, the term "or" as used in either the detailed description or the claims is intended to mean an inclusive "or" rather than an exclusive "or". That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Additionally, in the subject description, the word "exemplary" (and variants thereof) is used to mean serving as an example, instance, or illustration. Any aspect or design described herein as "exemplary" is not necessarily to be construed as preferred or advantageous over other aspects or designs. Rather, use of the word "exemplary" is intended to present concepts in a concrete manner.

What is claimed is:

1. A closure, comprising:

a skirt configured to engage a container, the skirt comprising a rim with a locking element for engaging a top, a first hinge and an indented portion that is at an opposite end of the skirt relative to the first hinge wherein the top is an uninterrupted geometric shape;

the top connected to the skirt at the first hinge, the first hinge being positioned at a second end of the skirt opposite a first end, the top being movable relative to the skirt wherein the top further comprises an extended lip that overhangs the indented portion;

a lid operatively attached to the top at a second hinge, the lid being movable relative to the top, a distal end of the lid positioned at the second end of the skirt; and the second hinge positioned between the first hinge and an end of the top opposite the first, the top and the lid forming an essentially flat surface.

2. The closure of claim 1, wherein the top is movable in a first direction and the lid is movable in a second direction.

3. The closure of claim 1, wherein the closure is fully open in response to the top being raised.

4. The closure of claim 1, wherein the closure is partially open in response to the lid being raised and the top being closed.

5. The closure of claim 1, wherein a width of the indented portion matches a width of the lid.

6. The closure of claim 1, wherein the first hinge and the second hinge are living hinges.

7. The closure of claim 1, wherein the locking elements are locking beads.

8. The closure of claim 1, wherein the top comprises a rim with a locking bead that engages the skirt.

9. The closure of claim 1, wherein the lid comprises a locking element on an edge of the lid that operatively engages with another locking element on an internal edge of the top.

10. The closure of claim 1, wherein the top has a rounded radial edge.

11. The closure of claim 1, wherein the top has a chamfered radial edge.

12. A container assembly, comprising:

a container;

a closure comprising:

a skirt that operatively engages the container, the skirt comprising a rim with a locking element for engaging a top, a first hinge and a thumbtab that is on an opposite end of the skirt from the first hinge;

a first flap connected to the skirt at the first hinge, the first flap having an extended lip that overhangs the thumbtab, an uninterrupted geometric shape, a distal end opposite the connection to the first hinge and being movable relative to the skirt;

a second flap operatively attached to the first flap at a second hinge, the second flap being movable relative to the first flap, and having a distal end positioned opposite the attachment of the second flap to the second hinge, wherein the second hinge is positioned between the first hinge and an end of the top opposite the first hinge, the top and the flap forming an essentially flat surface.

13. The container assembly of claim 12, wherein the closure is fully open in response to the first flap being raised.

14. The container assembly of claim 12, wherein the closure is partially open in response to the second flap being raised.

* * * * *